US011585042B2

(12) United States Patent
Leibman et al.

(10) Patent No.: US 11,585,042 B2
(45) Date of Patent: Feb. 21, 2023

(54) DRYER APPLIANCE WITH ADDITIVE DISPENSER

(71) Applicant: Haier US Appliance Solutions, Inc., Wilmington, DE (US)

(72) Inventors: Alexander B. Leibman, Prospect, KY (US); Dandu Arish, Louisville, KY (US); Sainath Akella, Louisville, KY (US); Eleazar Alvarez, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 88 days.

(21) Appl. No.: 17/037,958

(22) Filed: Sep. 30, 2020

(65) Prior Publication Data

US 2022/0098786 A1 Mar. 31, 2022

(51) Int. Cl.
*D06F 58/20* (2006.01)

(52) U.S. Cl.
CPC ..... *D06F 58/203* (2013.01)

(58) Field of Classification Search
CPC ..... D06F 58/203; D06F 58/04; F04B 7/0266; F04B 9/02; F04B 9/06; F04B 17/03; F04B 23/02; F04B 53/1032
USPC ..... 34/60, 61, 380, 381, 389; 417/415, 471, 417/571
See application file for complete search history.

(56) References Cited

U.S. PATENT DOCUMENTS

| | | | | |
|---|---|---|---|---|
| 4,891,890 | A * | 1/1990 | Church | D06F 58/203 34/389 |
| 6,306,420 | B1 | 10/2001 | Cheikh | |
| 7,850,663 | B2 | 12/2010 | Ferriter | |
| 10,378,139 | B2 | 8/2019 | Hunjun | |
| 2009/0272004 | A1* | 11/2009 | Chernetski | D06F 58/10 34/389 |
| 2018/0016734 | A1* | 1/2018 | Green | D06F 58/46 |
| 2018/0363635 | A1* | 12/2018 | Boersma | A61C 17/225 |

FOREIGN PATENT DOCUMENTS

| | | | |
|---|---|---|---|
| CA | 2887296 | A1 | 4/2014 |
| CN | 102459744 | B | 4/2014 |
| CN | 107531394 | A1 | 1/2018 |
| EP | 1631345 | B1 | 10/2011 |
| JP | 6015889 | B2 | 10/2016 |
| JP | 2017500990 | A | 1/2017 |
| KR | 100308175 | B1 | 11/2001 |
| KR | 100491424 | B1 | 5/2005 |
| KR | 20080064171 | A1 | 7/2008 |

(Continued)

*Primary Examiner* — John P McCormack
(74) *Attorney, Agent, or Firm* — Dority & Manning, P.A.

(57) ABSTRACT

A dryer appliance includes a cabinet. The cabinet defines an interior volume. A drum is rotatably mounted within the interior volume of the cabinet. The drum defines a chamber for the receipt of clothes for drying. An additive reservoir is mounted in the cabinet. The dryer appliance also includes a spray nozzle for spraying additive from the reservoir into the chamber. The dryer appliance further includes a pump which pumps the additive from the reservoir to the spray nozzle. The pump may be spring-loaded and may include a piston and a spring. The pump may be connected to the reservoir by a first one-way valve and may be connected to the spray nozzle by a second one-way valve.

18 Claims, 7 Drawing Sheets

(56) References Cited

FOREIGN PATENT DOCUMENTS

| | | | |
|---|---|---|---|
| KR | 20090096747 | A | 9/2009 |
| KR | 20150006260 | A | 1/2015 |
| WO | WO2012087823 | A2 | 6/2012 |

* cited by examiner

DRYER APPLIANCE WITH ADDITIVE DISPENSER

FIELD OF THE INVENTION

The present subject matter relates generally to dryer appliances, and more particularly to dryer appliances that utilize a reservoir and pump for providing additives to a load within the dryer appliances.

BACKGROUND OF THE INVENTION

A conventional appliance for drying articles, e.g., articles of clothing, such as a clothes dryer (or laundry dryer) typically includes a cabinet having a rotating drum for tumbling clothes and laundry articles therein. One or more heating elements heat air prior to the air entering the drum, and the warm air is circulated through the drum as the clothes are tumbled to remove moisture from laundry articles in the drum. Gas or electric heating elements may be used to heat the air that is circulated through the drum.

In operation, ambient air from outside is drawn into the cabinet and passed through the heater before being fed to the drum. Moisture from the clothing is transferred to the air passing through the drum. Typically, this moisture laden air is then transported away from the dryer by, for example, a duct leading outside of the structure or room where the dryer is placed. The exhausted air removes moisture from the dryer and the clothes are dried as the process is continued by drawing in more ambient air.

In certain situations, it may be desirable to provide one or more additives to the clothes within the drum, e.g., additives may be provided to reduce wrinkling, to improve the scent of the clothes, and/or other fabric treatment additives such as fabric softener may be provided. For example, a user may prefer more fragrant clothes, or the laundry may have been sitting in the drying chamber for an extended period and may smell slightly stale or musty. Conventional means of providing additives include manually placing dryer sheets or other additives within the drying chamber prior to activation of the dryer. Alternatively, clothes may be washed and dried again, resulting in excessive energy and water usage.

Accordingly, a dryer appliance having improved features for storing an additive and selectively providing the additive to the interior of the drum would be advantageous.

BRIEF DESCRIPTION OF THE INVENTION

Aspects and advantages of the invention will be set forth in part in the following description, or may be obvious from the description, or may be learned through practice of the invention.

In one aspect of the present disclosure, a dryer appliance is provided. The dryer appliance includes a cabinet. The cabinet defines an interior volume. A drum is rotatably mounted within the interior volume of the cabinet. The drum defines a chamber for the receipt of clothes for drying. A reservoir is mounted in the cabinet. The reservoir is configured for receipt of an additive. The dryer appliance also includes a spray nozzle mounted proximate the chamber and configured to deliver a spray of the additive from the reservoir into the chamber. A spring-loaded pump is connected to and in fluid communication with the reservoir and the spray nozzle. The spring-loaded pump is downstream of the reservoir and upstream of the spray nozzle. The spring-loaded pump includes a piston and a spring in operative communication with the piston. The spring urges the piston toward an outlet of the pump to push the additive from the pump to the spray nozzle.

In another aspect of the present disclosure, a dryer appliance is provided. The dryer appliance includes a cabinet. The cabinet defines an interior volume. A drum is rotatably mounted within the interior volume of the cabinet. The drum defines a chamber for the receipt of clothes for drying. A reservoir is mounted in the cabinet. The reservoir is configured for receipt of an additive. The dryer appliance also includes a spray nozzle mounted proximate the chamber and configured to deliver a spray of the additive from the reservoir into the chamber. A pump is connected to and in fluid communication with the reservoir and the spray nozzle. The pump is downstream of the reservoir and upstream of the spray nozzle. The pump is connected to the reservoir by a first one-way valve and connected to the spray nozzle by a second one-way valve.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
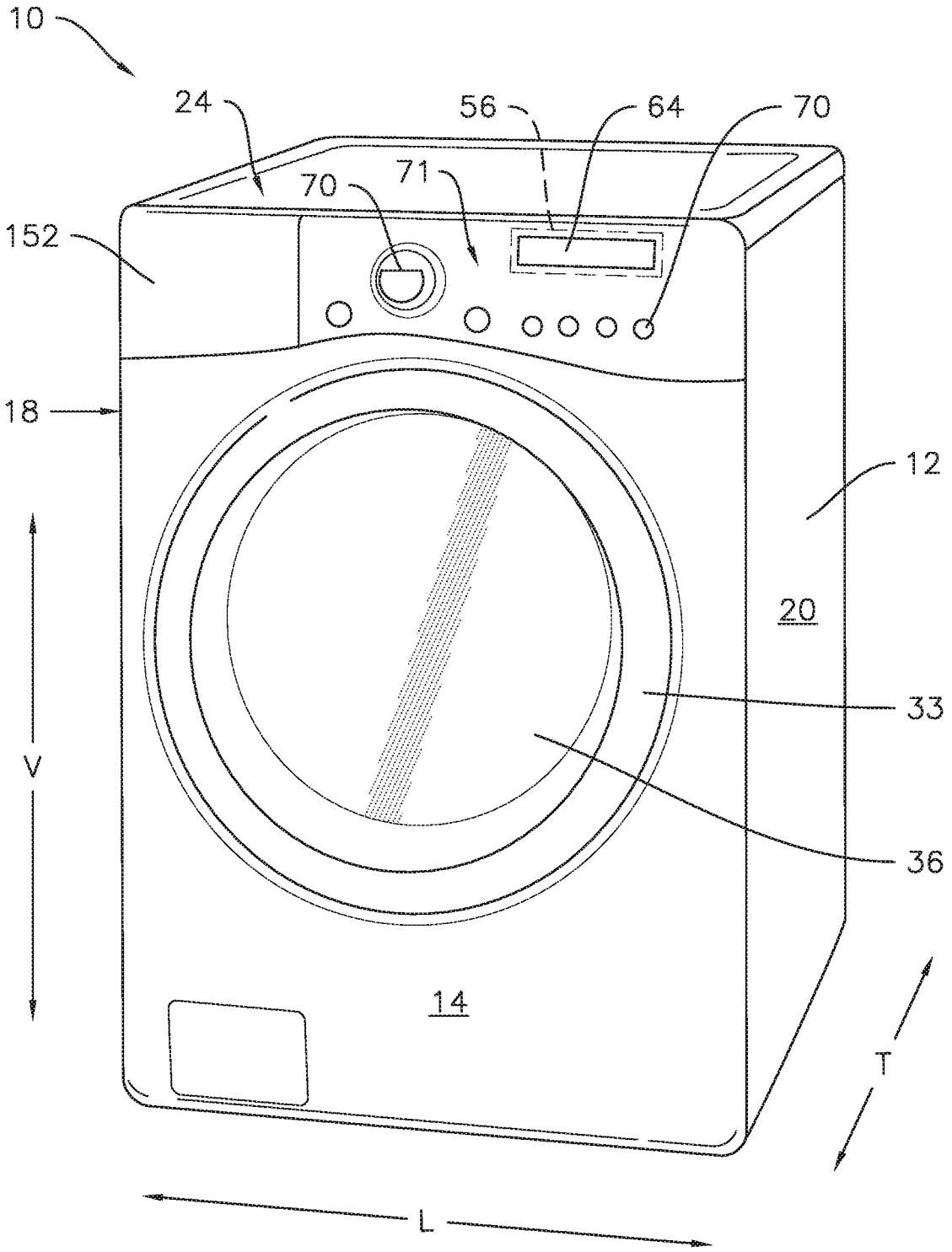
FIG. 1 provides a perspective view of a dryer appliance in accordance with one or more exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "substantially," "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
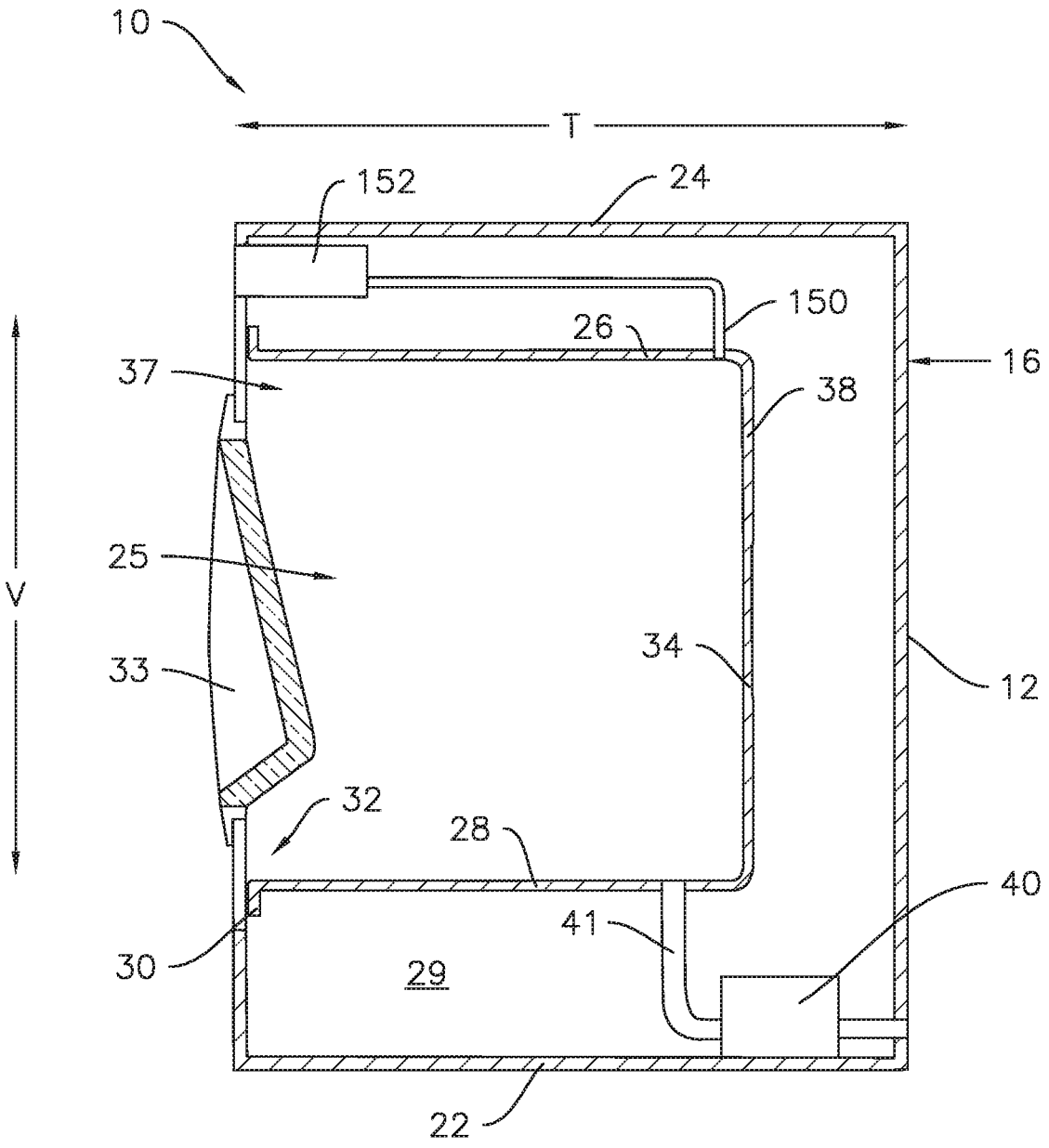
FIG. 2 provides a cross-section view of the example dryer appliance of FIG. 1.

Turning now to the figures, FIG. 1 provides a perspective view of a dryer appliance 10 according to exemplary embodiments of the present disclosure. FIG. 2 provides a section view of dryer appliance 10. Dryer appliance 10 generally defines a vertical direction V, a lateral direction L, and a transverse direction T, each of which is mutually perpendicular, such that an orthogonal coordinate system is defined. While described in the context of a specific embodiment of dryer appliance 10, using the teachings disclosed herein, it will be understood that dryer appliance 10 is provided by way of example only. Other dryer appliances having different appearances and different features may also be utilized with the present subject matter as well.

Cabinet 12 includes a front panel 14, a rear panel 16, a left side panels 18 and a right side panel 20 spaced apart from each other by front and rear panels 14 and 16, a bottom panel 22, and a top cover 24. As used herein, terms such as "left" and "right" or "front" and "back" refer to directions from the perspective of a user facing the dryer appliance 10 for accessing and/or operating the dryer appliance 10. For example, a user stands in front of the dryer appliance 10, e.g., at or near the front panel 14, to access door 33 and/or inputs 70 (the door 33 and inputs 70 are described in more detail below). Within cabinet 12, an interior volume 29 is defined. A drum or container 26 mounted for rotation about a substantially horizontal axis within the interior volume 29. Drum 26 defines a chamber 25 for receipt of articles of clothing for tumbling and/or drying. Drum 26 extends between a front portion 37 and a back portion 38. A supply duct 41 may be mounted to drum 26 and receives heated air that has been heated by a heating assembly or system 40.

As used herein, the terms "clothing" or "clothes" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance 10 (e.g., clothes dryer) and may include a mixture of different or similar articles of clothing of different or similar types and kinds of fabrics, textiles, garments and linens within a particular laundering process.

A motor (not pictured) may be provided in some embodiments to rotate drum 26 about the horizontal axis. Drum 26 is generally cylindrical in shape, having an outer cylindrical wall 28 and a front flange or wall 30 that defines an opening 32 of drum 26, e.g., at front portion 37 of drum 26, for loading and unloading of articles into and out of chamber 25 of drum 26. A plurality of lifters or baffles (not shown) may be provided within chamber 25 of drum 26 to lift articles therein and then allow such articles to tumble back to a bottom of drum 26 as drum 26 rotates. Such baffles may be mounted to drum 26 such that baffles rotate with drum 26 during operation of dryer appliance 10.

Drum 26 includes a rear wall 34 rotatably supported within main housing 12 by a suitable fixed bearing. Rear wall 34 can be fixed or can be rotatable. Rear wall 34 may include, for instance, a plurality of holes that receive hot air that has been heated by a heating system 40, which may include, e.g., a resistance heating element, a gas burner, and/or a heat pump. Moisture laden, heated air is drawn from drum 26 by an air handler, such as blower fan, which generates a negative air pressure within drum. The air passes through a duct enclosing screen filter, which traps lint particles. As the air passes from the blower fan, it enters a duct and then is passed into heating system 40. Heated air (with a lower moisture content than was received from drum 26), exits heating system 40 and returns to drum 26 by duct 41. After the clothing articles have been dried, they are removed from the drum 26 via opening 32. A door 33 provides for closing or accessing drum 26 through opening 32. A window 36 (FIG. 1) may be provided in door 33 for viewing of the chamber 25 of drum 26 and/or laundry articles therein, e.g., during operation of the dryer appliance 10.

In some embodiments, one or more selector inputs 70, such as knobs, buttons, touchscreen interfaces, etc., may be provided or mounted on the cabinet 12, e.g., on a control panel 71 thereof and are in operable communication (e.g., electrically coupled or coupled through a wireless network band) with a processing device or controller 56. The control panel 71 may also include a display 64. Controller 56 may also be provided in operable communication with various components of the dryer appliance, such as the motor, blower, and/or heating system 40. In turn, signals generated in controller 56 direct operation of such components in response to the position of inputs 70. As used herein, "processing device" or "controller" may refer to one or more microprocessors, microcontroller, ASICS, or semiconductor devices and is not restricted necessarily to a single element. The controller 56 may be programmed to operate dryer appliance 10 by executing instructions stored in memory (e.g., non-transitory media). The controller 56 may include, or be associated with, one or more memory elements such as RAM, ROM, or electrically erasable, programmable read only memory (EEPROM). For example, the instructions may be software or any set of instructions that when executed by the processing device, cause the processing device to perform operations.

Referring now to FIGS. 3 through 7, a system for introducing an additive 1000 into drying chamber 25 (and thus the clothes 2000 drying therein) will be described according to an exemplary embodiment of the present subject matter. As shown, e.g., in FIGS. 1 through 4, in some exemplary embodiments, dryer appliance 10 may include a reservoir 152 mounted in the cabinet 12. The reservoir 152 may be configured to hold an additive 1000, such as a liquid additive, and may be in fluid communication with, e.g., fluidly connected to, the chamber 25. For example, the reservoir 152 may be in fluid communication with one or more spray nozzles 146 (FIG. 4) which is or are positioned and arranged to provide a spray of additive from the reservoir 152 into the chamber 25, such as onto clothing articles 2000 therein. Reservoir 152 may advantageously be visible and accessible from the front of the dryer appliance 10 (e.g., as illustrated in FIG. 1).

Figure 3:
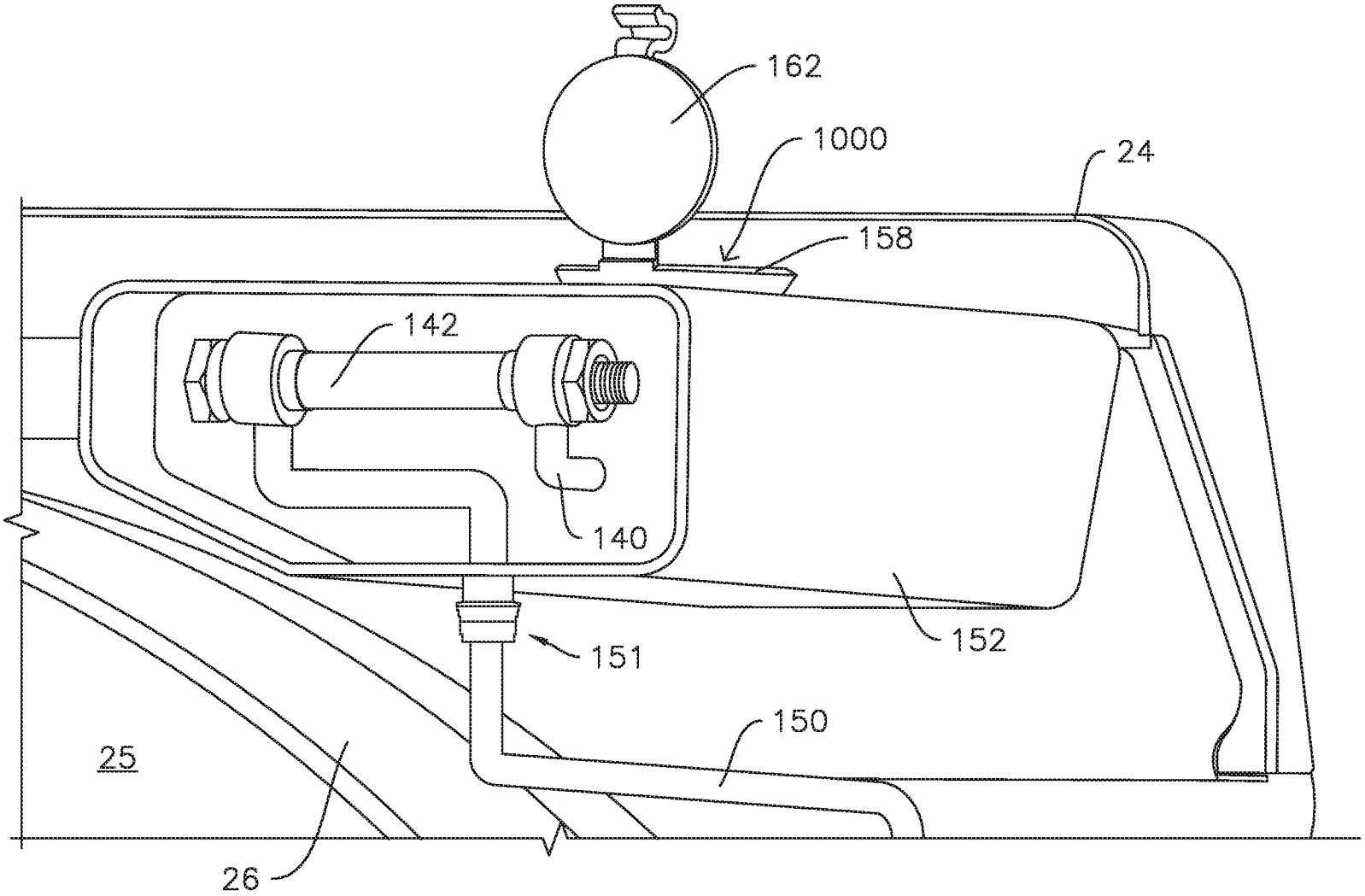
FIG. 3 provides an enlarged view of internal components within a portion of the dryer appliance of FIG. 1.
Figure 4:
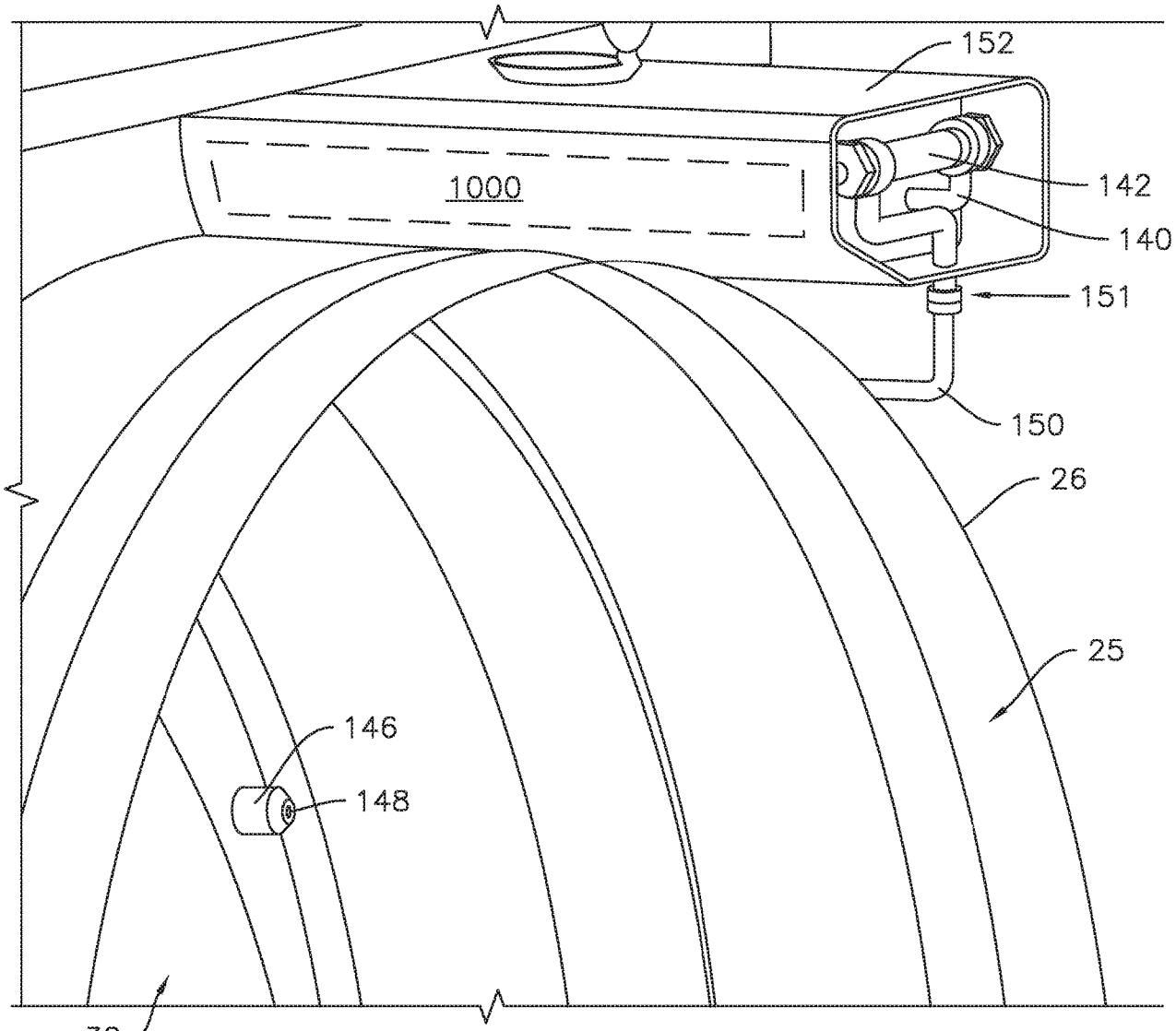
FIG. 4 provides an enlarged view of internal components within a portion of the dryer appliance of FIG. 1.

As illustrated in FIGS. 3 and 4, the reservoir 152 may be in fluid communication with the chamber 25 via one or more spray nozzles 146 (FIG. 4). For example, as shown in FIGS. 3 and 4, the reservoir 152 may be connected to a pump 142 by a first conduit 140. The pump 142 may be connected to the spray nozzle(s) 146 by a second conduit 150. In some embodiments, the pump 142 may be mounted to the reservoir 152 and the second conduit 150 may include a detachable coupling 151 therein to accommodate movement of the reservoir 152 and the pump 142 relative to the cabinet 12, e.g., when the reservoir 152 and, in such embodiments, the pump 142 mounted thereto, are removed from the cabinet 12, the detachable coupling 151 allows a first portion of the second conduit 150 which is attached directly to the pump 142 to be removed from the cabinet 12 while a second portion of the second conduit 150 which is directly attached to the spray nozzle 146 remains in the cabinet 12. When the reservoir 152 is re-inserted into the cabinet 12, the detachable coupling 151 is reconnected to complete the connection from the pump 142 to the spray nozzle(s) 146 via the second conduit 150.

Accordingly, as will be understood, the pump 142 may be operable to draw fluid, e.g. liquid additive, from the reservoir 152 and to urge the fluid from the pump 142 to the spray nozzle 146 through the second conduit 150. As may be seen in FIG. 4, the spray nozzle 146 may be positioned proximate the opening 32 of the drum 26 and oriented to direct a spray of additive 1000 into the chamber 25 of the drum 26. For example, the spray nozzle 146 may include an aperture 148 (FIG. 4) oriented away from the opening 32 and into or towards the chamber 25. As will be understood, pressure provided to the additive by the pump 142 and the small size of the aperture 148, e.g., which may be relatively small in diameter and/or cross-sectional area as compared to the conduits 140 and 150 upstream of the spray nozzle 146, provide a spray of additive from the spray nozzle 146 into the chamber 25.

Figure 5:
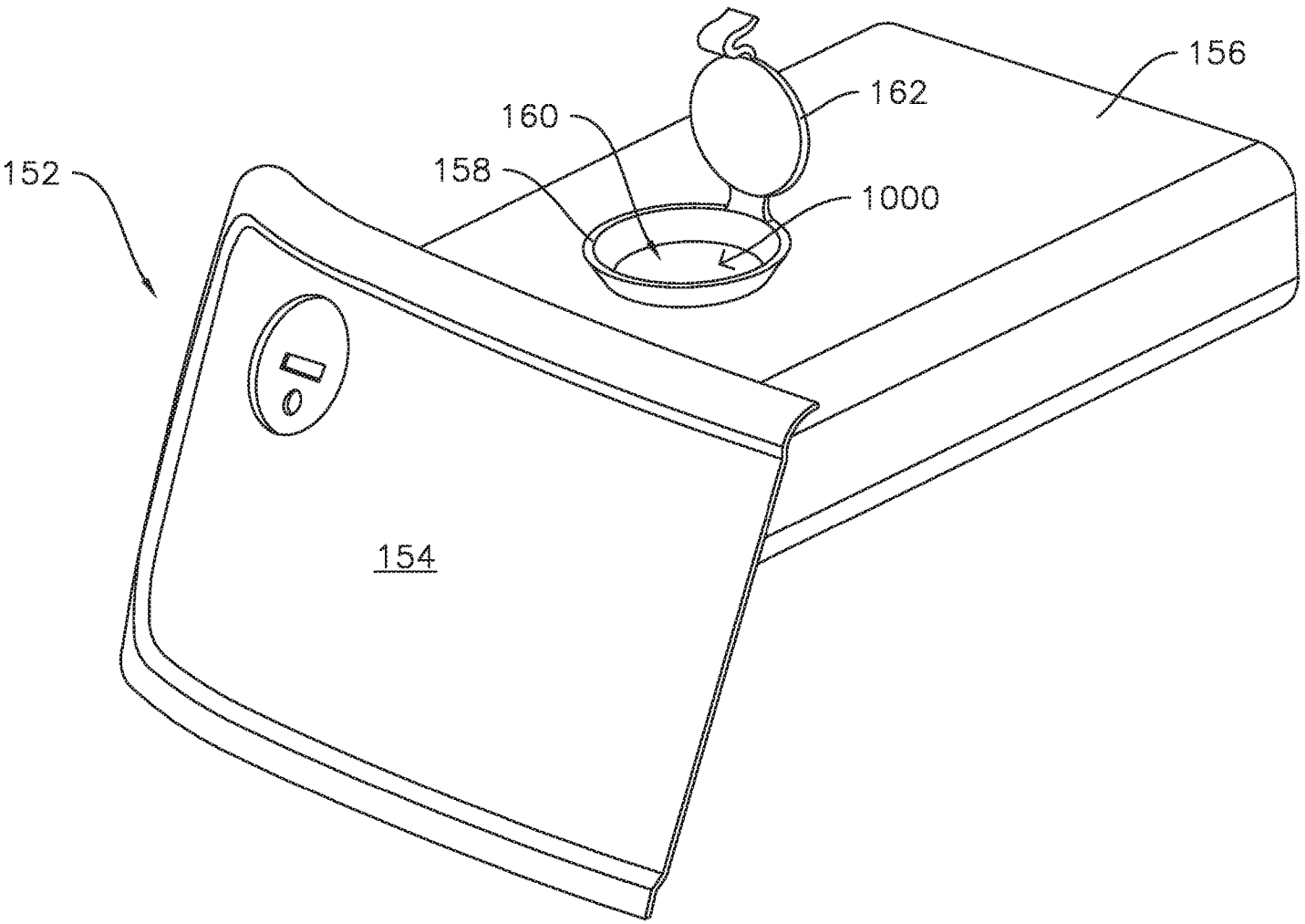
FIG. 5 provides a perspective view of a reservoir for a dryer appliance according to one or more exemplary embodiments of the present disclosure.

FIG. 5 provides a perspective view of the reservoir 152 according to one or more example embodiments of the present disclosure. As illustrated in FIG. 5, the reservoir 152 may include a face plate 154. For example, the reservoir 152 may be removable from the cabinet 12, e.g., the reservoir 152 may be removably mounted in the cabinet 12, in order to fill the reservoir 152 with additive 1000, for example via the inlet 158, as illustrated by arrow 1000 in FIG. 5. When the reservoir 152 is in a closed or installed position within the cabinet 12, e.g., as illustrated in FIGS. 1 and 2, the face plate 154 of the reservoir 152 may be generally flush, e.g., offset by no more than ten percent of a thickness of the face plate 154 along the transverse direction T (FIGS. 1 and 2), with the front panel 14 of the cabinet 12 and/or the control panel 71. The reservoir 152 may further include a body 156 within which an internal volume of the reservoir 152 is defined. An inlet 158 may be provided in the body 156 and may define an opening 160 which extends through the body 156, e.g., from an exterior of the body into the internal volume of the reservoir 152 therein. The opening 160 may thereby provide for access to the internal volume of the reservoir 152, such as for filling the reservoir 152 with an additive 1000. The reservoir 152 may further include a cap 162, and the cap 162 may be configured for selectively sealingly engaging with the inlet 158 when the cap 162 is in a closed position (not shown) and permitting access to the inlet 158 when the cap 162 is in an open position (e.g., as shown in FIG. 5). The cap 162 may be removably attached to the inlet 158 when in the closed position by any suitable mechanism, such as but not limited to, a snap fit, a press fit, a threaded connection, a bayonet-type connection, or any other suitable connection. For example, as illustrated in FIG. 5, in some embodiments, the cap 162 may be hingedly attached to the inlet 158 and may be configured to enclose the inlet 158 via a snap fit when the cap 162 is in the closed position. As shown in FIGS. 3 and 5, the additive 1000 may be poured into the reservoir at the inlet 158, as indicted by arrow 1000. In FIG. 4, the additive 1000 is depicted within the reservoir 152.

Figure 6:
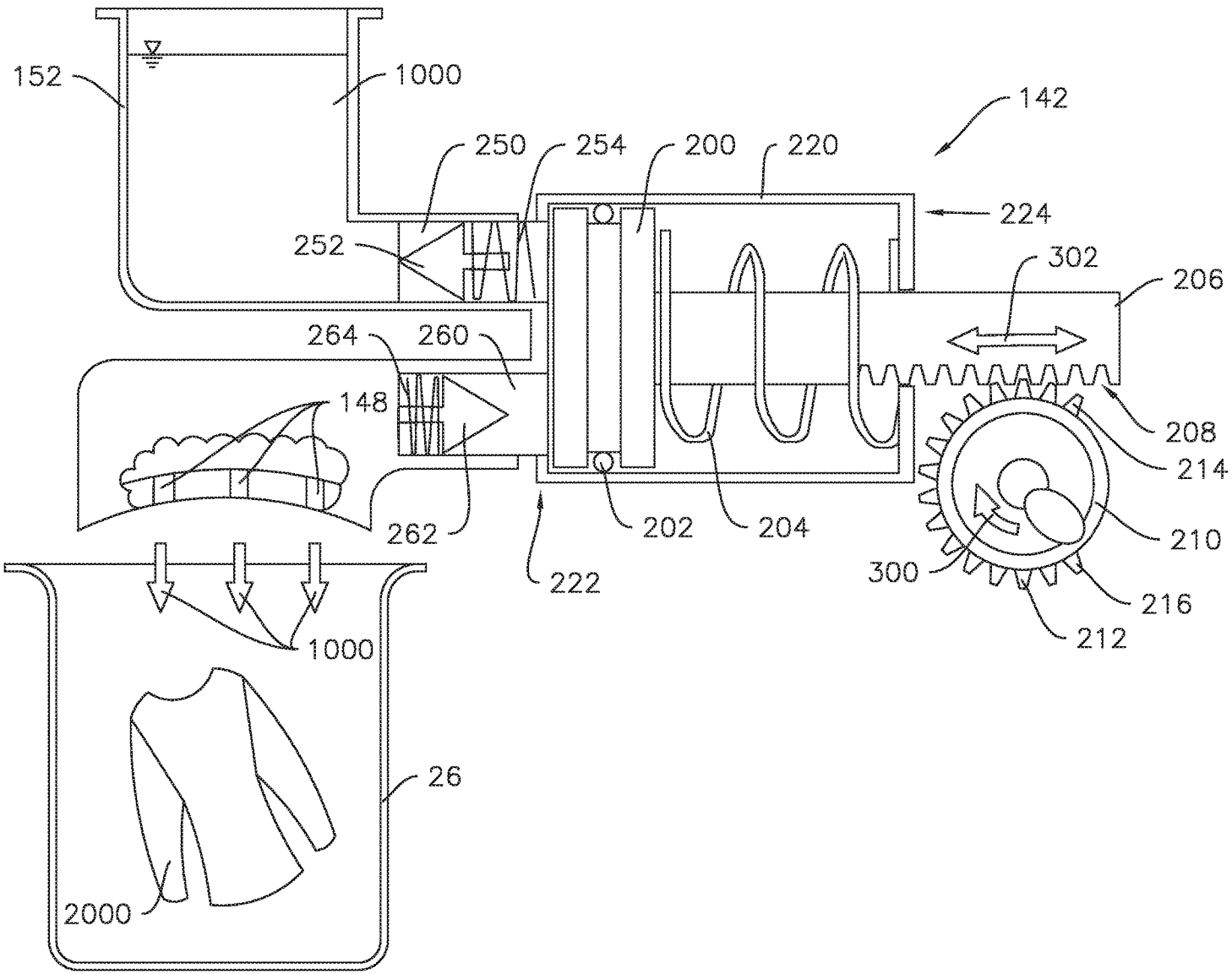
FIG. 6 provides a schematic view of an additive system for a dryer appliance according to one or more exemplary embodiments of the present disclosure with a pump of the additive system in a first position.
Figure 7:
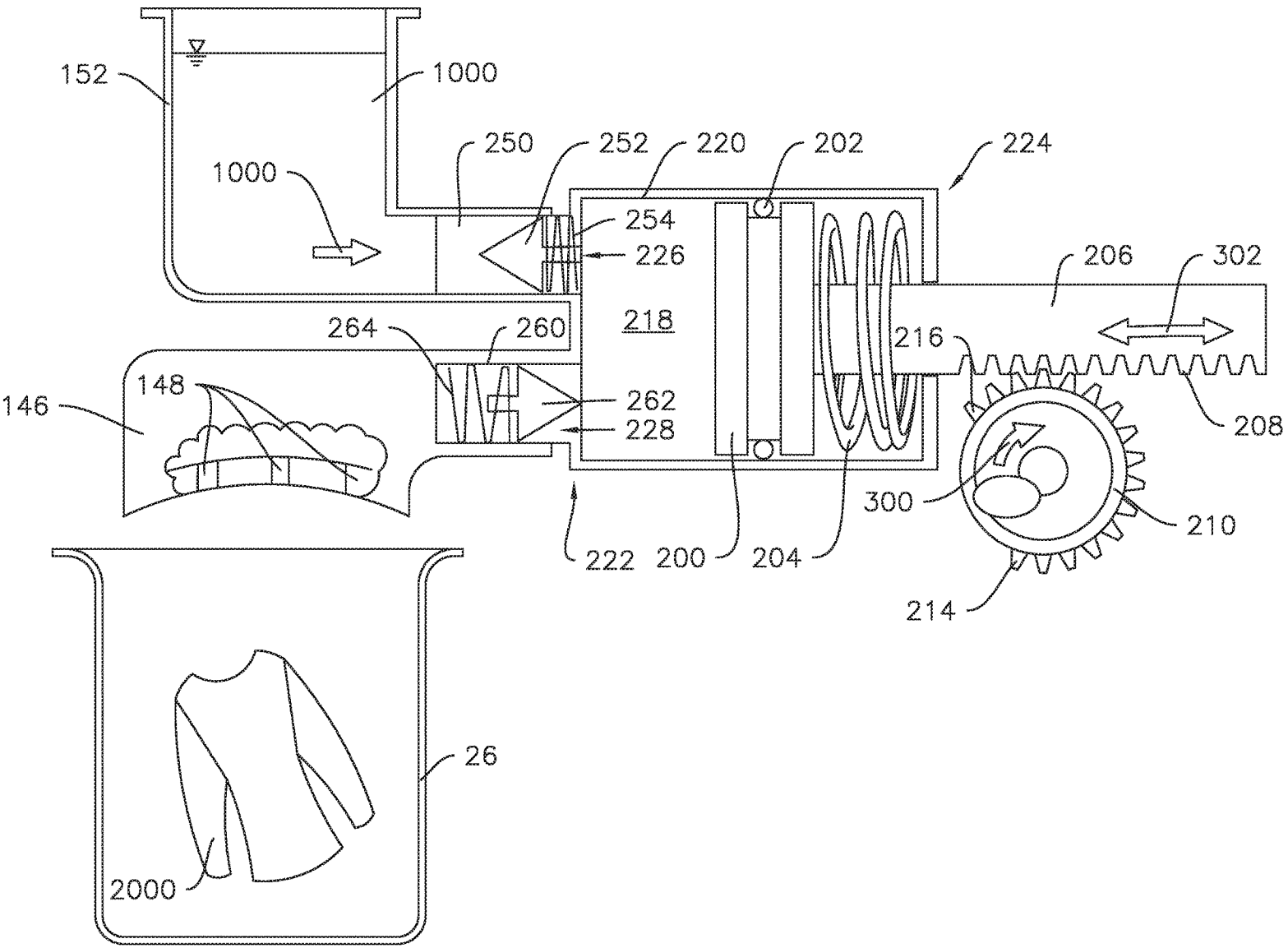
FIG. 7 provides a schematic view of the additive system of FIG. 6 with the pump in a second position.

Turning now to FIGS. 6 and 7, an additive dispensing system for a dryer appliance, such as but not limited to the dryer appliance 10 illustrated and described above, according to one or more embodiments of the present disclosure is schematically illustrated. As illustrated in FIGS. 6 and 7, the additive dispensing system includes a reservoir 152, a pump 142 and at least one spray nozzle 146. As shown, the pump 142 may be connected to and in fluid communication with the reservoir 152 and the spray nozzle 146. For example, the pump 142 may be downstream of the reservoir 152 such that fluid, e.g., additive 1000, flows from the reservoir 152 to the pump 142, and the pump 142 may be upstream of the spray nozzle 146 such that fluid, e.g., additive 1000, flows from the pump 142 to the spray nozzle 146 (and from the spray nozzle 146 into the chamber 25 defined within the drum 26).

In some embodiments, e.g., as illustrated in FIGS. 6 and 7, the pump 142 may be a spring-loaded pump. For example, the pump 142 may include a piston 200. The piston 200 may be sealingly engaged with an interior wall of a housing 220 of the pump, such as via a seal 202, e.g., an O-ring 202 as illustrated in FIGS. 6 and 7, whereby the piston 200 and the seal 202 define a fluid volume within the pump 142, e.g., fluid which enters the pump 142 may be prevented or obstructed from passing the piston 200 by the seal 202 and the volume within the pump 142 which the fluid may occupy may depend on the position of the piston 200 and the seal 202. In such embodiments, the pump 142 may further include a spring 204 in operative communication with the piston 200, e.g., the spring 204 may be connected to the piston 200, such as at an upstream or dry side of the piston 200. As will become clear from the following description, the upstream or dry side of the piston 200 is the side of the piston 200 which faces away from fluid, e.g., additive 1000, flowing through the pump 142 and is separated from the fluid volume within the pump 142 by the seal 202. As a result of the connection and/or operative communication between the spring 204 and the piston 200, the spring 204 urges the piston 200 toward an outlet 228 (FIG. 7) of the pump 142 to push the additive 1000 from the pump 142 to the spray nozzle 146.

Still referring to FIGS. 6 and 7, in some embodiments, the pump 142 may include a housing 220 which defines a cavity 218 (FIG. 7). In some embodiments, e.g., as illustrated in FIGS. 6 and 7, the housing 220 may extend from a first end 222 to a second end 224. In such embodiments, the housing 220 may terminate at and be bounded by each of the first end 222 and the second end 224. For example, the piston 200 may be movable along an axial direction, e.g., as indicated by arrow 302 in FIGS. 6 and 7, and the housing 220 may extend along the axial direction from the first end 222 to the second end 224.

As may be seen in FIGS. 6 and 7, the piston 200 may be disposed within the cavity 218. In such embodiments, the piston 200 may be movable within the cavity 218 between a first position proximate to an outlet 228 of the pump 142 and a second position distal from the outlet 228 of the pump. As mentioned above, the piston 200 may include a seal 202 thereon. In such embodiments, the seal 202 may define or delineate a fluid volume within the cavity 218. For example, the fluid volume may be defined between an inlet 226 of the pump 142 and the seal 202. As the piston 200 and the seal 202 carried thereon move within the cavity 218, the fluid volume within the cavity 218 expands and contracts. In some example embodiments, the first position of the piston 200 may be the position illustrated in FIG. 6 and the second position of the piston 200 may be the position illustrated in FIG. 7 or the second position of the piston 200 may be closer to the second end 224 than the position illustrated in FIG. 7. For example, as will be described in more detail below, the second position of the piston 200 may be reached when the last tooth 216 of a plurality of teeth 212 on a gear 210 disengages from a corresponding tooth of a plurality of teeth 208 connected to the piston 200. In such embodiments, the piston 200 draws the additive 1000 from the reservoir 152 into the cavity 218 when the piston 200 moves from the first position to the second position and the piston 200 urges the additive 1000 from the cavity 218 to the spray nozzle 146 when the spring 204 urges the piston 200 to return from the second position to the first position.

In some embodiments, the pump 142 may include a rack and pinion mechanism configured to move the piston 200 from the first position to the second position, e.g., by converting rotary motion to linear motion. In some embodiments, the pump 142 may include a shaft 206 connected to the piston 200. In such embodiments, the shaft 206 may include a first plurality of teeth 208. The pump 142 may further include a gear 210, which may be connected to a motor, such as to a drive shaft of the motor, to rotate the gear 210 in direction 300, e.g., clockwise on the page as illustrated for example in FIGS. 6 and 7. Exemplary motors and drive shafts thereof are understood by those of ordinary skill in the art and, as such, the motor is not specifically illustrated or described further herein for the sake of brevity and clarity.

In some embodiments, e.g., as illustrated in FIGS. 6 and 7, the pump 142 may include a shaft 206 connected to the piston 200, for example the shaft 206 may be integrally formed with the piston 200, and the shaft 206 may include a first plurality of teeth 208 formed thereon. In such embodiments, the gear 210 may include a second plurality of teeth 212. Also as illustrated in FIGS. 6 and 7, the second plurality of teeth 212 may extend only partially around the circumference of the gear 210. Thus, the first plurality of teeth 208 on the shaft 206 may be selectively engaged with the second plurality of teeth 212 whereby rotation of the gear 210 moves the shaft 206, and the piston 200 which is connected to, e.g., integrally formed with, the shaft 206, linearly from the first position to the second position. When the second plurality of teeth 212 extends only partially around the circumference of the gear 210, the first plurality of teeth 208 may be selectively engaged with the second plurality of teeth 212 in that the teeth 208 and 212 are engaged during only a portion of each revolution of the gear 210. The second plurality of teeth 212 may include and be bounded by a first tooth 214 and a second tooth 216. The spacing between the first tooth 214 and the second tooth 216, e.g., the portion of the circumference of the gear 210 which does not include the second plurality of teeth 212, may define selective disengagement of the teeth 208 and 212. For example, the teeth 208 and 212 may be engaged while the gear 210 rotates along the direction 300 from a point of initial engagement between the first tooth 214 of the second plurality of teeth 212 with a corresponding one of the first plurality of teeth 208 until the gear 210 rotates to a point at which the gear 210 disengages from the shaft 206 when the gear 210 rotates past the last tooth 216 of the second plurality of teeth 212, e.g., when the last tooth 216 of the second plurality of teeth 212 disengages from a corresponding tooth of the first plurality of teeth 208. Continuing the example, the teeth 208 and 212 may then be disengaged during the portion of each revolution of the gear 210 along the direction 300 which is after the last tooth 216 and before the first tooth 214.

In various embodiments, the pump 142 may further include a biasing element, e.g., spring 204, within the housing 220 and coupled to the piston 220. Thus, the piston 200 may compress the biasing element, e.g., spring 204, when the gear 210 moves the piston 200 to the second position, e.g., as illustrated in FIG. 7 where spring 204 is nearly fully compressed between the piston 200 and the second end 224 of the housing 220. Thus, the biasing element, e.g., spring 204 may urge the piston 200 from the second position to the first position when the gear 210 disengages from the shaft 206. For example, when the last tooth 216 of the second plurality of teeth 212 rotates past the corresponding tooth of the first plurality of teeth 208 with which the last tooth 216 was engaged, the shaft 206 and piston 200 are no longer constrained against movement along the axial direction (the axial direction being, e.g., as indicated by arrow 302 in FIGS. 6 and 7, as mentioned above) towards the first end 222 of the housing 220, such that the compressed spring 204 may then urge the piston 200 towards the first end 222 of the housing 220, e.g., the spring 204 may urge the piston 200 to return to the first position in which the piston 200 is proximate the first end 222 of the housing 220. As will be described in more detail below, when in the first position, the piston 200 may also be proximate to one or more valves 250 and 260, an inlet 226 of the pump 142, and/or an outlet 248 of the pump 142, some or all of which may be positioned at the first end 222 of the housing 220 in various embodiments.

In some embodiments, e.g., as illustrated in FIGS. 6 and 7, the pump 142 may include an inlet 226 and outlet 228, e.g., the inlet 226 and the outlet 228 may be formed in the housing 220 and may provide fluid communication with, e.g., a flow of fluid into and out of, the cavity 218. The pump 142 may be connected to the reservoir 152 by a first one-way valve 250, e.g., positioned in or at the inlet 226 of the housing 220, and the pump 142 may be connected to the spray nozzle 146 by a second one-way valve 260, e.g., positioned in or at the outlet 228 of the housing 220. As illustrated for example in FIGS. 6 and 7, the first one-way valve 250 may be positioned and configured to provide or permit fluid communication only from the reservoir 152 to the pump 142 and the second one-way valve 260 may be positioned and configured to provide or permit fluid communication only from the pump 142 to the spray nozzle 146, e.g., the one-way valves 250 and 260 may prevent or obstruct fluid flow from the spray nozzle 146 to the pump 142 and/or from the pump 142 to the reservoir 152. As illustrated for example in FIGS. 6 and 7, the first one-way valve 250 may include a plunger 252 and a biasing element 254. The biasing element 254 may bias the plunger 252 towards the reservoir 152, such that fluid flowing from the reservoir 152 to the pump 142 may overcome the biasing force of the biasing element 254, thereby opening the first one-way valve 250 (e.g., as in FIG. 7) to permit fluid flow, e.g., a flow of additive as indicated by arrow 1000 in FIG. 7, from the reservoir 152 to the pump 142. Conversely, fluid flow from the pump 142 to the reservoir 152 would be in concert with, rather than counter to, the biasing force of the biasing element 254 of the first one-way valve 250, whereby such flow would not move the plunger 252 of the first one-way valve 250 and would not open or pass through the first one-way valve 250. Similarly, the second one-way valve 260 may also include a plunger 262 and a biasing element 264 which may be generally the same in structure and function as the corresponding parts of the first one-way valve 250 described above, with the exception that the second one-way valve 260 may be oppositely oriented to the first one-way valve, whereby the second one-way valve 260 permits fluid flow from the pump 142 to the spray nozzle 146 when the force of the fluid flowing from the cavity 218 within the housing 220 is sufficient to overcome the biasing force of the biasing element 264 and open the second one-way valve 260, whereas flow of fluid from the spray nozzle 146 to the pump 142 would be in concert with, e.g., along the same general direction as, the biasing force of the biasing element 264 and thus would not open the second one-way valve 260.

In some embodiments, e.g., as illustrated in FIGS. 6 and 7, the inlet 226 and the outlet 228 may each be positioned at the same end of the housing 220, e.g., at the first end 222 as illustrated in FIGS. 6 and 7. In such embodiments, the first one-way valve 250 and the second one-way valve 260 may thus also be located at the same end, e.g., first end 222, of the housing 220. Thus, in such embodiments, the piston 200 may move away from the first one-way valve 250 when the piston 200 moves from the first position to the second position, to draw the fluid, e.g., additive 1000, into the cavity 218 thereof through the first one-way valve 250 and the piston 200 may move towards the second one-way valve 260 when the piston 200 moves from the second position to the first position to urge the fluid, e.g., additive 1000, from the cavity 218 to the spray nozzle 146 through the second one-way valve 260. Additionally, as indicated in FIG. 6, the additive 1000 may then be sprayed onto articles 2000 within the drum 26 via the spray nozzle 146, such as through one or more apertures 148 in the spray nozzle 146.

In various embodiments, pump 142 may be activated only when a specific set of operating parameters exist, e.g., such as when heating system 40 is off and drum 26 is spinning. For example, activating the pump 142 when the heating system 40 is off may occur immediately after a drying cycle, or following a short delay, e.g., a few seconds, after a drying cycle. As such, clothes within the chamber 25 may still be warm, e.g., at an elevated temperature relative to room temperature, when the additive from the reservoir 152 is sprayed into the chamber 25, which may promote or enhance the effects of certain additives such as fragrances. Rotation of the drum 26 while spraying the additive may promote even distribution of the additive on clothes within the chamber 25, and in some cases may provide additional benefits. For example, when the additive includes a wrinkle releaser, agitation of the clothes due to rotation of the basket 26 may increase effectiveness of the wrinkle releaser. In some embodiments, the pump 142 may be activated when the basket 25 is not spinning and/or when the blower fan is not operating, to reduce the additive from the spray nozzle 146 getting drawn into the air circulation system of the dryer appliance 10. In some embodiments, the pump 142 may be activated in response to a user selection, which may be selected via one or more of the inputs 70. For example, a dedicated "refresh" cycle and/or "add scent" option for one or more standard dryer cycles may be provided. In some embodiments, the pump 142 may be activated automatically when a certain period of time has elapsed after completion of a dry cycle and the door 33 has not been opened, indicating that articles may have remained in the chamber 25 for an extended period of time.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance, comprising:

a cabinet defining an interior volume;

a drum rotatably mounted within the interior volume of the cabinet, the drum defining a chamber for the receipt of clothes for drying;

a reservoir mounted in the cabinet and configured for receipt of an additive, the reservoir comprising a body, the body of the reservoir removable from the cabinet;

a spray nozzle mounted proximate the chamber and configured to deliver a spray of the additive from the reservoir into the chamber;

a spring-loaded pump connected to and in fluid communication with the reservoir and the spray nozzle, the spring-loaded pump downstream of the reservoir and upstream of the spray nozzle, the spring-loaded pump comprising a piston and a spring in operative communication with the piston whereby the spring urges the piston toward an outlet of the pump to push the additive from the pump to the spray nozzle, wherein the pump is mounted to the body of the reservoir, whereby the pump is removable from the cabinet with the reservoir; and a conduit connecting the pump to the spray nozzle, the conduit including a detachable coupling.

2. The dryer appliance of claim 1, wherein the pump comprises a housing which defines a cavity, wherein the piston is disposed within the cavity, and wherein the piston is movable within the cavity between a first position proximate to an outlet of the pump and a second position distal from the outlet of the pump, whereby the piston draws the additive from the reservoir into the cavity when the piston moves from the first position to the second position and the piston urges the additive from the cavity to the spray nozzle when the spring urges the piston to return from the second position to the first position.

3. The dryer appliance of claim 2, wherein the pump is connected to the reservoir by a first one-way valve and is connected to the spray nozzle by a second one-way valve.

4. The dryer appliance of claim 3, wherein the piston is movable within the housing along an axial direction, the housing extends along the axial direction from a first end to a second end, and wherein the first one-way valve and the second one-way valve are disposed at the first end of the housing.

5. The dryer appliance of claim 2, further comprising a rack and pinion mechanism configured to move the piston from the first position to the second position.

6. The dryer appliance of claim 2, further comprising a shaft connected to the piston, the shaft comprising a first plurality of teeth, and a gear comprising a second plurality of teeth, the first plurality of teeth selectively engaged with the second plurality of teeth whereby rotation of the gear moves the shaft and the piston linearly from the first position to the second position.

7. The dryer appliance of claim 6, wherein the gear comprises a circumference, the second plurality of teeth extending partially around the circumference of the gear, whereby the gear disengages from the shaft when the gear rotates past a last tooth of the second plurality of teeth.

8. The dryer appliance of claim 7, wherein the pump comprises a biasing element within the housing and coupled to the piston, whereby the piston compresses the biasing element when the gear moves the piston to the second position, and whereby the biasing element urges the piston from the second position to the first position when the gear disengages from the shaft.

9. The dryer appliance of claim 8, wherein the piston is movable within the housing along an axial direction, the housing extends along the axial direction from a first end to a second end, and wherein the biasing element is positioned between the piston and the second end of the housing along the axial direction.

10. A dryer appliance, comprising:

a cabinet defining an interior volume;

a drum rotatably mounted within the interior volume of the cabinet, the drum defining a chamber for the receipt of clothes for drying;

a reservoir mounted in the cabinet and configured for receipt of an additive, the reservoir comprising a body, the body of the reservoir removable from the cabinet;

a spray nozzle mounted proximate the chamber and configured to deliver a spray of the additive from the reservoir into the chamber;

a pump connected to and in fluid communication with the reservoir and the spray nozzle, the pump downstream of the reservoir and upstream of the spray nozzle, the pump connected to the reservoir by a first one-way valve and connected to the spray nozzle by a second one-way valve, wherein the pump is mounted to the body of the reservoir, whereby the pump is removable from the cabinet with the reservoir; and a conduit connecting the pump to the spray nozzle, the conduit including a detachable coupling.

11. The dryer appliance of claim 10, wherein the pump comprises a housing which defines a cavity and a piston disposed within the cavity, wherein the piston is movable within the cavity between a first position proximate to an outlet of the pump and a second position distal from the outlet of the pump, whereby the piston draws the additive from the reservoir into the cavity through the first one-way valve when the piston moves from the first position to the second position and the piston urges the additive from the cavity to the spray nozzle through the second one-way valve when the piston returns from the second position to the first position.

12. The dryer appliance of claim 11, wherein the pump comprises a biasing element within the housing and coupled to the piston, whereby the biasing element urges the piston from the second position to the first position.

13. The dryer appliance of claim 11, wherein the piston is movable within the housing along an axial direction, the housing extends along the axial direction from a first end to a second end, and wherein the first one-way valve and the second one-way valve are disposed at the first end of the housing.

14. The dryer appliance of claim 11, further comprising a rack and pinion mechanism configured to move the piston from the first position to the second position.

15. The dryer appliance of claim 11, further comprising a shaft connected to the piston, the shaft comprising a first plurality of teeth, and a gear comprising a second plurality of teeth, the first plurality of teeth selectively engaged with the second plurality of teeth whereby rotation of the gear moves the shaft and the piston linearly from the first position to the second position.

16. The dryer appliance of claim 15, wherein the gear comprises a circumference, the second plurality of teeth extending partially around the circumference of the gear, whereby the gear disengages from the shaft when the gear rotates past a last tooth of the second plurality of teeth.

17. The dryer appliance of claim 16, wherein the pump comprises a biasing element within the housing and coupled to the piston, whereby the piston compresses the biasing element when the gear moves the piston to the second position, and whereby the biasing element urges the piston from the second position to the first position when the gear disengages from the shaft.

18. The dryer appliance of claim 17, wherein the piston is movable within the housing along an axial direction, the housing extends along the axial direction from a first end to a second end, and wherein the biasing element is positioned between the piston and the second end of the housing along the axial direction.

* * * * *